US005097979A

United States Patent [19]

McDermott et al.

[11] Patent Number: 5,097,979

[45] Date of Patent: Mar. 24, 1992

[54] BASKET LINER

[76] Inventors: Susan M. McDermott, 12216 Izard St.; Mary Jo Ellis, 1405 N. 127th Cir., both of Omaha, Nebr. 68154

[21] Appl. No.: 690,109

[22] Filed: Apr. 23, 1991

[51] Int. Cl.[5] ..... B65D 90/04

[52] U.S. Cl. ..... 220/404; 220/470; 217/3 R

[58] Field of Search ..... 220/9.1, 403, 404, 470; 383/33; 217/3 R, 125

[56] References Cited

U.S. PATENT DOCUMENTS

| | | | |
|---|---|---|---|
| 1,465,367 | 8/1923 | Schwartz | 220/404 |
| 1,653,556 | 12/1927 | Faber | 220/404 X |
| 2,610,757 | 9/1952 | Irvine | 383/76 X |
| 3,349,936 | 10/1967 | Morton et al. | 220/470 X |
| 4,993,551 | 2/1991 | Lindsay | 383/39 X |

*Primary Examiner*—Stephen Marcus
*Assistant Examiner*—Jes F. Pascua
*Attorney, Agent, or Firm*—Zarley, McKee, Thomte, Voorhees & Sease

[57] ABSTRACT

A basket liner designed for use with a basket of the type having an upstanding stationary handle includes a sheet of fabric with forward and rearward edges, and opposing side edges. In one embodiment of the invention a button and buttonhole are provided along the forward and rearward edges of the sheet to permit fastening of the sheet to the stationary basket handle. In a second embodiment of the invention, the sheet is provided with a plurality of buttonholes along the forward and rearward edges through which a ribbon may be woven which may be tied to the basket handle to secure the basket liner in position.

4 Claims, 3 Drawing Sheets

BASKET LINER

TECHNICAL FIELD

The present invention relates to fabric liners for baskets, and more particularly to an improved basket liner which may be anchored to the basket.

BACKGROUND OF THE INVENTION

Baskets have been utilized for centuries for the transportation and display of various products. It is, therefore, desirable to provide lining for such baskets, so as to create decorative alternatives for the consumer.

It is therefore a general object of the present invention to provide an improved basket liner.

Another object of the present invention is to provide a basket liner which may be anchored into position.

Yet another object of the present invention is to provide a basket liner with anchors which are decorative in nature.

Yet another object is to provide a basket liner which is simple and economical to manufacture.

Still another object of the present invention is t provide a basket liner which is quick and simple to utilize.

These and other objects will be apparent to those skilled in the art.

SUMMARY OF THE INVENTION

The basket liner of the present invention is designed for use with a basket of the type having a upstanding stationary handle. The basket liner includes a sheet of fabric with forward and rearward edges, and opposing side edges. In one embodiment of the invention a button and buttonhole are provided along the forward and rearward edges of the sheet to permit fastening of the sheet to the stationary basket handle. In a second embodiment of the invention, the sheet is provided with a plurality of buttonholes along the forward and rearward edges through which a ribbon may be woven which may be tied to the basket handle to secure the basket liner in position.

DESCRIPTION OF THE PREFERRED EMBODIMENTS

Figure 1:
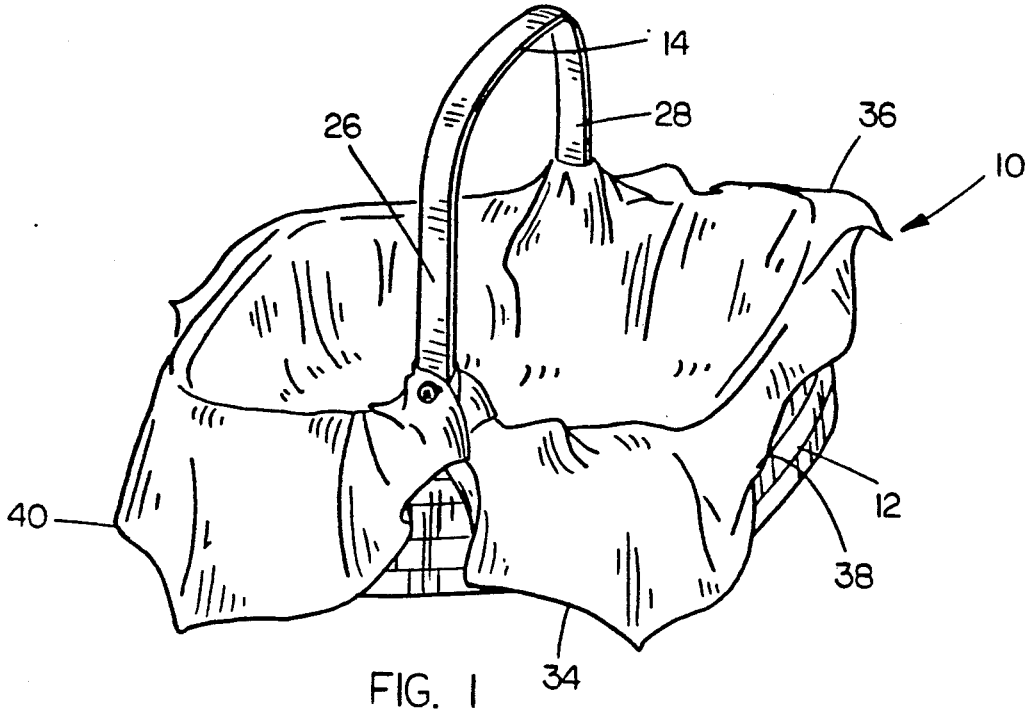
FIG. 1 is a perspective view of the basket liner of the present invention mounted on a basket.

Referring now to the drawings, in which similar or corresponding parts are identified with the same reference numeral, and more particularly to FIG. 1, the basket liner of the present invention is designated generally at 10 and is shown fastened to a basket 12 having an upstanding handle 14.

Figure 3:
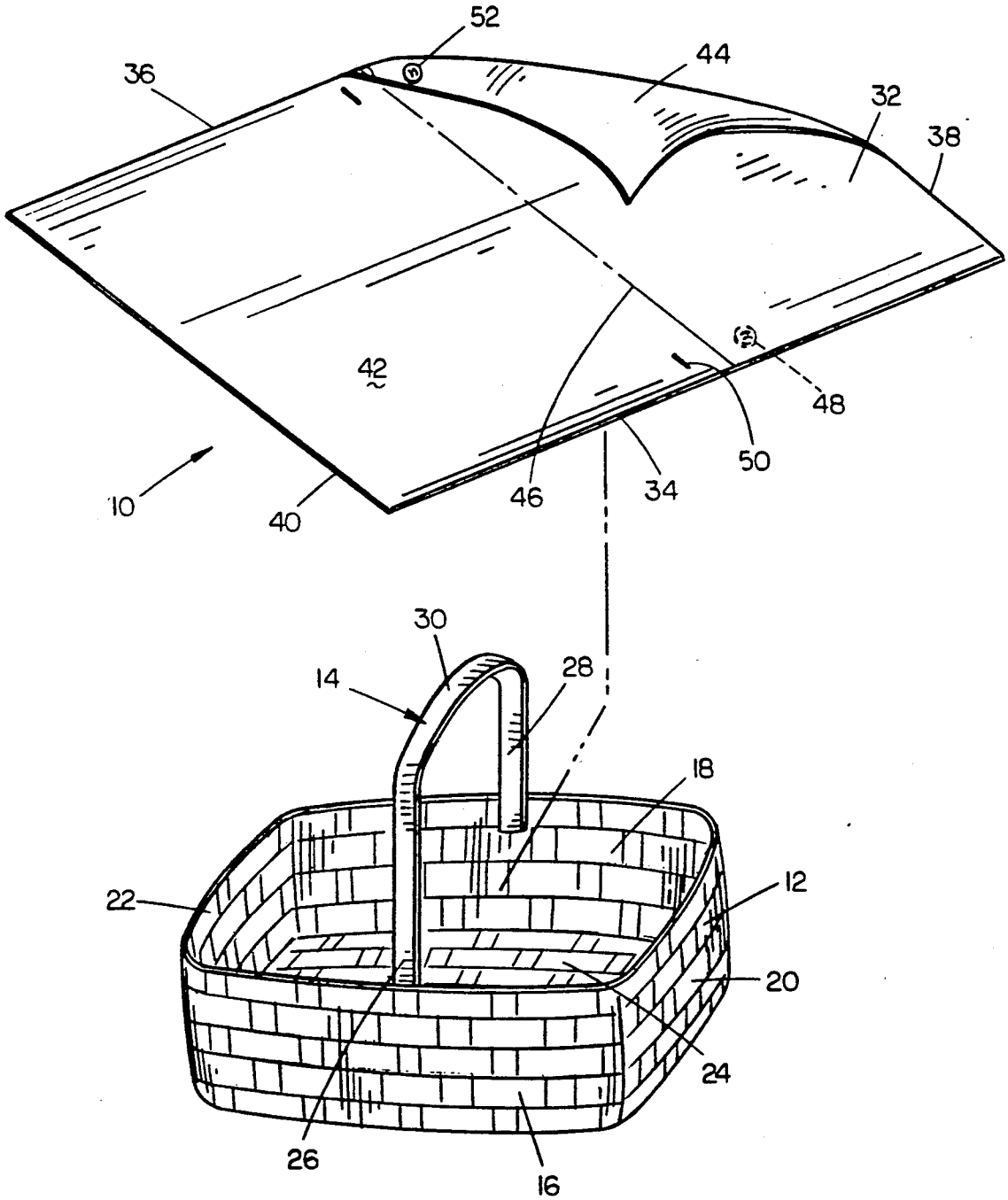
FIG. 3 is a perspective view of a basket with the basket liner of this invention removed therefrom.

Referring now to FIG. 3, basket 12 has forward and rearward upstanding panels 16 and 18 respectively, opposing upstanding side panels 20 and 22 and a bottom 24. Handle 14 includes a pair of legs 26 and 28 affixed to front and rear panels 16 and 18 respectively, and projecting upwardly therefrom. Legs 26 and 28 are connected by a cross-member 30 to form generally U-shaped handle 14.

Basket liner 10 is formed from a generally rectangular sheet of fabric 32 and includes a forward edge 34, rearward edge 36 opposing side edges 38 and 40 a upper surface 42 and lower surface 44. A center line 46 is indicated on fabric sheet 32 and is located midway between side edges 38 and 40.

Preferably, fabric sheet 32 has a width, as measured along side edges 38 and 40, approximately equal to the height of front and rear panels 16 and 18 and the width of bottom 24 (as measured between front and rear panels 16 and 18) of basket 12. Similarly, it is preferred that the length of fabric sheet 32 is equal to the length of basket bottom 24 added to the height of side panels 20 and 22. In this way, when basket liner 10 is installed in basket 12, the respective edges 34, 36, 38 and 40 will drape over the sides of the basket, as shown in FIG. 1.

A button 48 is sewn to the lower surface 44 of fabric sheet 32 adjacent to and spaced slightly from forward edge 34 and adjacent but spaced slightly from center line 46, as shown in FIG. 3. A buttonhole 50 is formed in fabric sheet 32 and spaced the same distance from center line 46 but on the opposite side thereof, to receive button 48 when fabric sheet 32 is fastened to basket 12. A second button 52 is affixed to the lower surface 44 of sheet 32 directly opposite button 48, adjacent rear edge 36. A second buttonhole 54 is formed in sheet 32 adjacent rear edge 36 directly opposite buttonhole 50, to receive button 52 when sheet 32 is affixed to basket 12.

Figure 2:
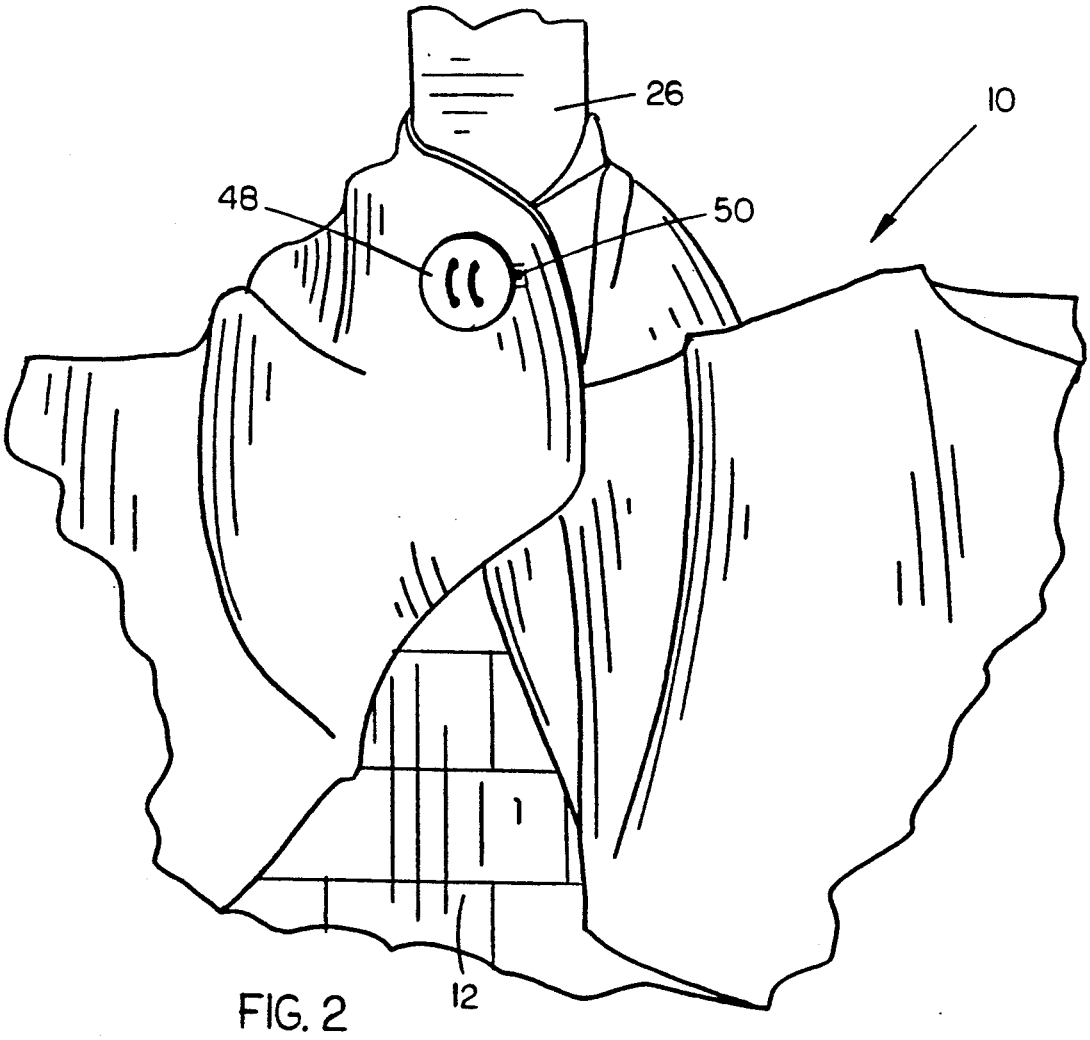
FIG. 2 is an enlarged perspective view of one anchor point of the liner to the basket of FIG. 1.

As shown in FIGS. 1 and 2, basket liner 10 is anchored to basket 12 by laying sheet 32 into basket 12 with the lower surface 44 contacting the bottom 24 of the basket. Button 48 will be facing forward panel 16, and a portion of forward edge 34 is wrapped around leg 26 of handle 14 so as to fasten button 48 through buttonhole 50 to anchor basket liner 10 to leg 26. A similar process is utilized with leg 28 of handle 14 to fasten basket liner 10 thereto.

Figure 4:
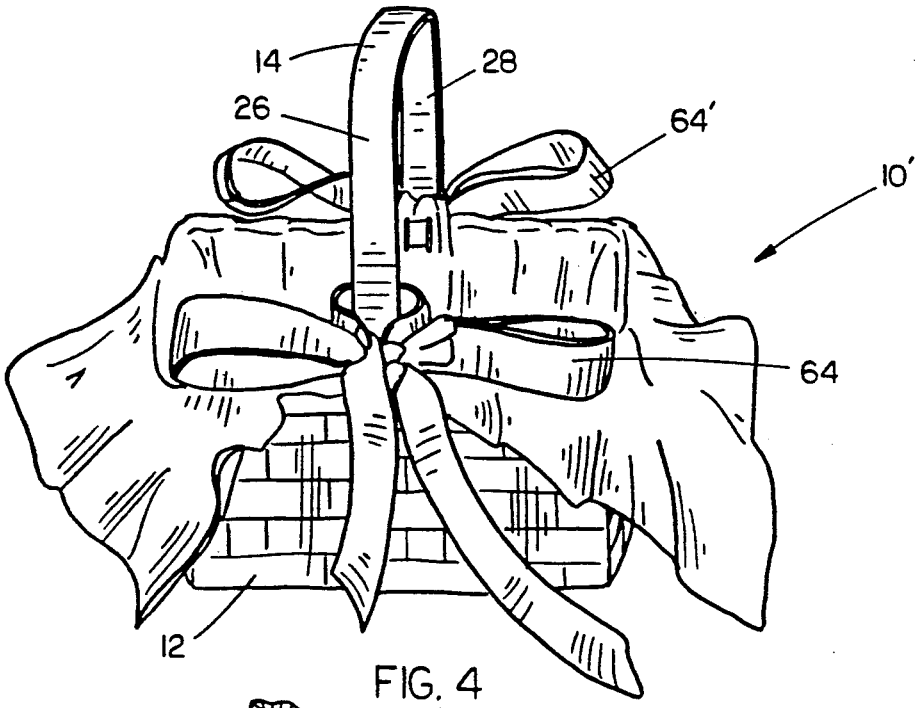
FIG. 4 is a perspective view of a second embodiment of the basket liner of the invention.
Figure 5:
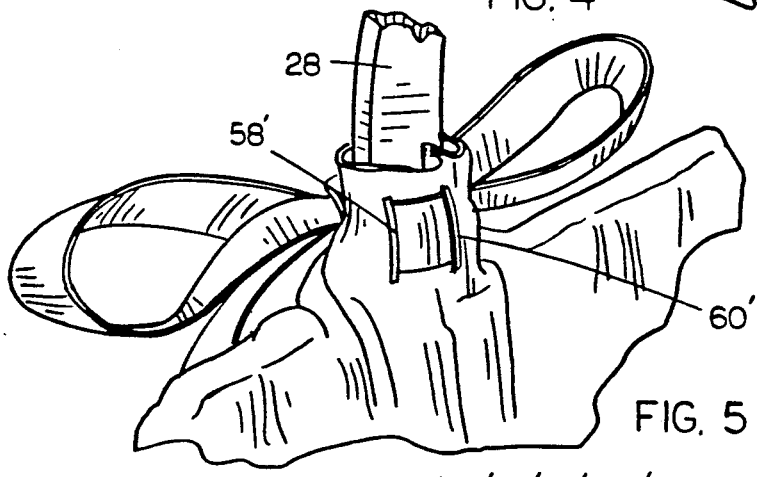
FIG. 5 is a enlarged perspective view of one anchor of the second embodiment of the invention.
Figure 6:
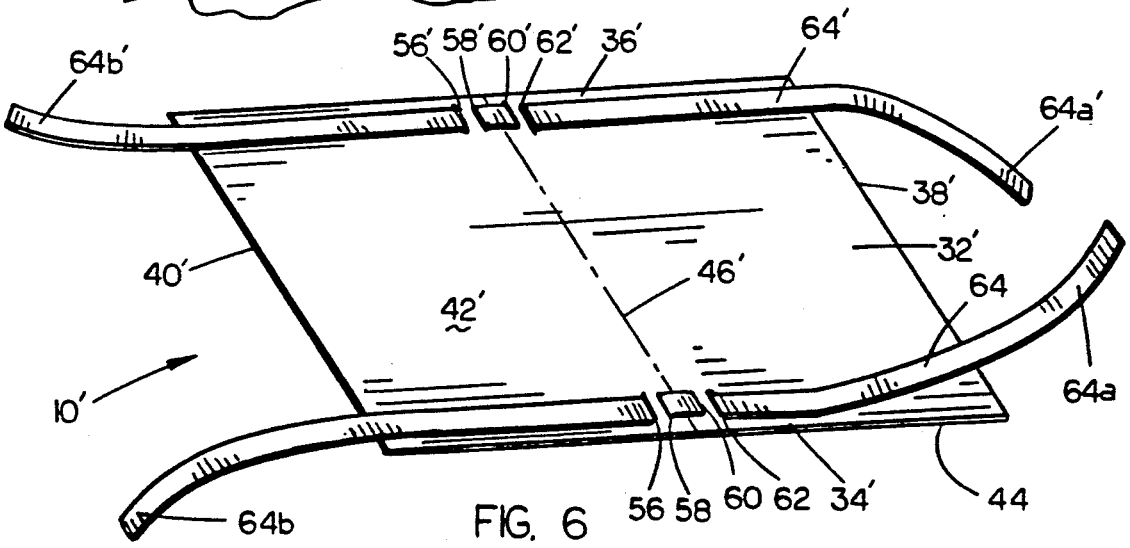
FIG. 6 is a perspective view of the second embodiment of the basket liner removed from the basket.

Referring now to FIGS. 4, 5 and 6, a second embodiment of the basket liner is designated generally at 10' which is designed for anchoring to basket 12. As shown in FIG. 6, basket liner 10' begins with a sheet 32' having the same dimensions as the sheet 32 of the first embodiment, and including forward and rearward edges 34' and 36', side edges 38' and 40' and upper and lower surfaces 42' and 44' respectively. A center line 46' is drawn on sheet 32' midway between side edges 38' and 40', merely for reference purposes.

Four buttonholes 56, 58, 60 and 62 are formed parallel to one another and spaced apart adjacent forward edge 34', with buttonholes 56 and 58 spaced equidistant away from center line 46' and opposite to buttonholes 60 and 62. A similar arrangement of buttonholes 56', 58', 60' and 62' are formed adjacent rear edge 36', as shown in FIG. 6.

An elongated strip of ribbon 64 is woven through buttonholes 56–62, downward through buttonhole 62 upward through buttonhole 60 downward through buttonhole 58 and thence upward through buttonhole 56 such that the ends 64*a* and 64*b* of the ribbon 64 extend along the upper surface 42' of sheet 32'. A second ribbon 64' is woven through buttonholes 56'–62' in the same fashion so as to be oriented parallel to ribbon 64.

Basket liner 10' is anchored to basket 12 by laying the liner in the basket with the lower surface 44' thereof in contact with the bottom of the basket. The portion of sheet 32' adjacent each leg 26 and 28 of handle 14 is wrapped around the respective handle leg 26 and 28 and ribbons 64 and 64' are tied together so as to anchor sheet 32' in position, as shown in FIG. 4. FIG. 5 shows the interior face of leg 28 and shows that buttonholes 58' and 60' are located interiorly of leg 28 with the remaining buttonholes 56' and 62' (not seen in FIG. 5) located towards the outside of leg 28. Preferably, ribbons 64 and 64' are tied in bows or some other decorative fashion.

Whereas the invention has been shown and described in connection with the preferred embodiments thereof, it will be understood that many modifications, substitutions and additions may be made which are within the intended broad scope of the appended claims. For example, the dimensions of the basket liner may be greater than the inner dimensions of the basket, to create additional overlapping edges. While a button is shown in the first embodiment of the invention, other types of fasteners may be utilized to anchor the basket liner in position on the legs of the handle.

There has therefore been shown and described an improved basket liner which accomplishes at least all of the above stated objects.

We claim:

1. A basket liner for a basket of the type having front and rear upstanding panels, opposing upstanding first and second side panels, a bottom, and a handle having a first leg projecting upwardly from said front panel and a second leg projecting upwardly from the rear panel, comprising:

a sheet of fabric having front and rear edges, opposing first and second side edges, an upper surface and a lower surface; first means adjacent the front edge of said sheet for connecting said sheet to said first leg of said handle; and second means adjacent the rear edge of said sheet for connecting said sheet to said second leg of said handle, whereby said sheet will generally line the interior of the basket when connected thereto;

said first connecting means including a plurality of parallel spaced apart buttonholes formed in said sheet adjacent to said front edge with a first ribbon means woven therethrough, said first ribbon having first and second ends protruding from said plurality of buttonholes adjacent the upper surface of the sheet;

said second connecting means including a second plurality of parallel, spaced apart buttonholes formed in said sheet adjacent the rear edge with a second ribbon means woven therethrough, said second ribbon having first and second ends protruding from said second plurality of buttonholes adjacent the upper surface of the sheet.

2. The basket liner of claim 1, wherein said first plurality of buttonholes are aligned opposite said second plurality of buttonholes.

3. In combination:

a basket having front and rear upstanding panels, opposing upstanding first and second side panels, a bottom, and a handle having a front leg projecting upward from said front panel and a second leg projecting upward from said rear panel;

a basket liner connected to said basket handle, comprising:

a sheet of fabric having front and rear edges, opposing first and second side edges, an upper surface and a lower surface;

first means adjacent the front edge of said sheet for connecting said sheet to said first leg of said handle; and second means adjacent to the rear edge of said sheet for connection said sheet to said second leg of said handle.

said first connecting means including a first plurality of parallel, spaced apart buttonholes formed in said sheet adjacent said front edge with a first ribbon means woven therethrough and tied to said first handle leg;

said second connecting means including a second plurality of parallel, spaced apart buttonholes formed in said sheet adjacent said rear edge with a second ribbon means woven therethrough and tied to said second handle leg.

4. In combination:

a basket having front and rear upstanding panels, opposing upstanding first and second side panels, a bottom, and a handle having a front leg projecting upward from said front panel and a second leg projecting upward from said rear panel;

a basket liner connected to said basket handle, comprising:

a sheet of fabric having front and rear edges, opposing first and second side edges, an upper surface and a lower surface;

first means adjacent the front edge of said sheet for connecting said sheet to said first leg of said handle;

said first connecting means including a first button attached to the lower surface of said sheet, and a first buttonhole formed in said sheet to receive said first button, spaced from said first button an equidistant from the front edge of said sheet;

second means adjacent to the rear edge of said sheet for connection said sheet to said second leg of said handle;

said second connecting means including a second button attach to the lower surface of said sheet, and a second buttonhole formed in said sheet to receive said second button, spaced from said second button an equidistant from the rear edge of said sheet;

a portion of said sheet between said first button and said first buttonhole being wrapped around said first leg and said first button fastened through said first buttonhole to connect said forward edge of said sheet to said first leg of said handle;

a portion of said sheet between said second button and second buttonhole being wrapped around said second leg with said second button fastened through said second buttonhole to connect the rear edge of said sheet to said second leg.

* * * * *